United States Patent [19]

Carmody et al.

[11] Patent Number: 4,796,705

[45] Date of Patent: Jan. 10, 1989

[54] SUBSURFACE WELL SAFETY VALVE

[75] Inventors: Michael A. Carmody; Jefferey J. Lembcke, both of Broken Arrow, Okla.

[73] Assignee: Baker Oil Tools, Inc., Orange, Calif.

[21] Appl. No.: 89,522

[22] Filed: Aug. 26, 1987

[51] Int. Cl.[4] ..... E21B 34/10

[52] U.S. Cl. ..... 166/323; 166/321; 251/62

[58] Field of Search ..... 166/321, 323, 332, 317; 251/62

[56] References Cited

U.S. PATENT DOCUMENTS

| | | | |
|---|---|---|---|
| 4,005,751 | 2/1977 | Page, Jr. | 166/321 |
| 4,119,146 | 10/1978 | Taylor | 166/321 X |
| 4,161,219 | 2/1979 | Pringle | 166/324 |
| 4,273,194 | 6/1981 | Pringle et al. | 166/323 |
| 4,444,266 | 4/1984 | Pringle | 166/321 X |
| 4,467,870 | 8/1984 | Langham | 166/321 |
| 4,503,913 | 3/1985 | Carmody | 166/321 X |
| 4,527,630 | 7/1985 | Pringle | 166/321 |
| 4,669,547 | 6/1987 | Pringle | 166/321 |

*Primary Examiner*—George A. Suchfield

*Assistant Examiner*—Bruce M. Kisliuk

*Attorney, Agent, or Firm*—Hubbard, Thurman, Turner & Tucker

[57] ABSTRACT

In a safety valve having an axially shiftable actuating sleeve operable to move a valve head from a closed to an open position, the actuating movement of the actuating sleeve is normally produced by a small diameter piston mounted on an axially extending spindle secured to the valve housing and cooperating with a primary cylinder which is abuttingly secured to the actuating sleeve. A secondary spindle and cooperating cylinder are provided which are supplied with fluid pressure by an entirely separate line extending to the well surface. The second cylinder has only abutting contact with the actuating sleeve and may be utilized to effect the movement of the actuating sleeve in the event of the failure of the primary cylinder. In a modification, a fixed cylinder housing defines a pair of secondary cylinder bores in which secondary rod pistons are slidably mounted to effect the movement of the actuating sleeve. In both modifications, collet latches prevent return movement of the secondary cylinder or secondary rod pistons, thus locking the valve head in an open position.

9 Claims, 10 Drawing Sheets

SUBSURFACE WELL SAFETY VALVE

BACKGROUND OF THE INVENTION

1. FIELD OF THE INVENTION

The invention relates to safety valves used in subterranean wells, such as oil or gas wells, and specifically to valves which are actuated in response to changes in control fluid pressure in a separate control line extending from the subsurface valve location to the well surface.

2. DESCRIPTION OF THE PRIOR ART

Subsurface safety valves are commonly used in oil or gas wells to prevent the escape of fluids from a producing formation in the event of damage at the well surface. Typically, these valves are incorporated into the fluid transmission production tubing which is inserted through the well casing and extends from the surface of the well to the producing formation. The flow of fluids through this inner tubing string must be interrupted in the event of damage to the well head at the surface. By positioning these valves at a location below the well surface, for example, below the mud line in an offshore well, the safety valve can be closed to prevent the escape of produced fluids.

The most common subsurface safety valves employ either a shiftable flapper or a rotatable ball valve head to open and close the fluid transmission conduit. Commonly, either a shiftable flapper or a ball valve head is actuated from closed to an open position in response to axial movement of an actuator sleeve. In conventional ball valves, downward movement of the actuator sleeve will impart rotation to a closed ball valve head to rotate a central passage through the ball into alignment with the fluid transmission conduit. In conventional flapper valves, the actuator sleeve will engage a closed flapper to shift the flapper to its open position by rotation in a vertical plane about the flapper hinge. In these conventional valves, axial movement of the actuator sleeve is normally imparted by an increase in control fluid pressure. Hydraulic control fluid is generally supplied through an external control line extending from the valve to the well surface. An increase in pressure can be initiated at the well surface and this increase in pressure is transmitted through the hydraulic control fluid to the downhole valve. Conventionally, unbalanced piston surfaces on the actuator sleeve are exposed to the control pressure and an increase in control pressure will result in an increase in the control force acting on the actuator sleeve. Eventually a sufficient pressure force will be created to urge the actuator sleeve downwardly relative to the closed flapper or ball valve head against the action of the well pressure and any spring which might be used to hold the actuator sleeve and the valve head in the closed position. When control fluid pressure is reduced or removed, for any reason, the well pressure and the spring acting on the actuator sleeve will be sufficient to shift the actuator sleeve upwardly permitting the valve head to close.

In addition to these conventionally actuated valves, some subsurface safety valves employ shiftable spools or pistons for actuating a flow tube actuator. These separate shiftable spools or pistons may be employed to reduce the surface area upon which the ambient well fluid pressure acts. A reduction in surface area means that the hydraulic pressure force opposing the shifting of the actuator sleeve to a valve-opening position is less, thus permitting the safety valve to be positioned at greater depths. U.S. Pat. Nos. 4,005,751, 4,119,146, 4,161,219, and 4,503,913 each disclose subsurface safety valves having a spool or piston mounted in the valve housing and operatively connected to the valve-actuator sleeve.

Occasionally, a defect or leak in the valve spool or piston will prevent the development of sufficient force to shift the actuator sleeve to a valve-opening position. In such case, the availability of a backup hydraulic system including a separate hydraulic line extending to the well surface is a desirable adjunct. More importantly, if the primary piston is not operable, it becomes immediately desirable that the safety valve be shifted to, and locked in, an open position to ensure that wireline tools may be inserted through the safety valve to effect the control of other tools located downhole relative to the safety valve.

Accordingly, it is highly desirable that safety valves operated by a small-diameter piston be provided with a backup hydraulic mechanism for not only effecting the movement of the safety valve from a closed to an open position, but also for effecting the locking of the safety valve in such open position. An economical, yet reliable, combination backup hydraulic mechanism and locking mechanism has not heretofore been provided in the prior art.

SUMMARY OF THE INVENTION

A subsurface well safety valve for use in controlling the flow in a fluid transmission conduit, such as a tubing string in a subterranean well, comprises an outer valve housing with a rotatable or shiftable valve closure member mounted therein. In the preferred embodiment of the invention, a flapper valve is pivotally attached to the valve housing for movement about a horizontal axis from an open to a closed position traversing the bore of the valve housing; but other conventional conduit closure members, such as a ball valve head, can be efficiently operated by apparatus embodying this invention. An axially shiftable actuator sleeve is telescopically mounted within the bore of the valve housing above the shiftable valve closure member for axial movement relative to both the valve housing and the valve closure member. Downward movement of the actuator sleeve will cause the bottom end of such sleeve to engage the upper surface of the flapper valve head to rotate the flapper to its open position. A plurality of axially extending spindles, preferably at least three, are fixedly mounted at one end to the valve housing and depend therefrom to lie within an annular chamber defined intermediate the actuator sleeve and the bore of the valve housing. At least two of the spindles are hollow and are respectively supplied with pressurized control fluids provided by two separate external control lines extending to the well surface.

A piston element is formed on the lower end of each of the hollow spindles. An axially shiftable cylinder sleeve is positioned around each of the hollow spindles and has a closed bottom end defining a fluid pressure chamber adjacent the lower end of the hollow spindle and communicating with the bore of the hollow spindle. The one hollow spindle, hereinafter referred to as a primary spindle, is abuttingly connected to the actuator sleeve so that the supply of control fluid pressure to the hollow bore of the primary spindle will effect a downward movement of its cooperating cylinder sleeve which will abuttingly engage the actuator sleeve to move such sleeve downwardly and effect the movement of the valve closure member to its open position. The second cylinder sleeve or cylinder surrounding the secondary hollow spindle is not affected by the downward motion of the primary cylinder sleeve. Thus, the normal operation of the safety valve is controlled solely by the supply of control fluid pressure to the primary cylinder sleeve.

In the event of leakage or breakage of the control line supplying the primary cylinder sleeve, a control fluid pressure may then be supplied to the secondary cylinder sleeve to react against the piston formed on the secondary spindle to move the secondary cylinder sleeve downwardly. Since the secondary cylinder sleeve is abuttingly engaged with the actuator sleeve, it will concurrently move the actuator sleeve downwardly and produce an opening of the shiftable valve closure member.

The secondary cylinder sleeve also mounts a collet on its exterior. Such collet has a ring portion surrounding the lower end of the secondary cylinder sleeve and upwardly extending arm portions terminating in inwardly enlarged head portions Such head portions project within apertures provided in the walls of the secondary cylinder sleeve, but such apertures are above the piston element provided on the secondary hollow spindle. The inwardly projecting collet arms thus slidably engage the external surface of the secondary cylinder and, when sufficient downward movement of the secondary cylinder has occurred to ensure that the abuttingly connected actuator sleeve has been moved to its valve-opening position, the collet heads will engage a downwardly facing abutment surface provided on the exterior of the secondary spindle to lock the secondary cylinder sleeve in its lowermost, valve-opening position. Thus, the safety valve is locked in its fully open position and wireline tools or well treatment fluids can be freely inserted through the safety valve to operate on the producing formation.

In accordance with a modification of this invention, a secondary cylinder housing is fixedly mounted in the annulus between the valve-actuating sleeve and the bore of the valve housing and defines two secondary cylinder bores disposed in parallel adjacent relationship. Fluid conduit means extending to the well surface are provided for concurrently supplying pressured fluid to the bores of the two adjacent secondary cylinders. A pair of elongated secondary piston rods slidably and sealably cooperate with the pair of secondary cylinder bores to define fluid pressure chambers above the piston portions of the secondary rods. The secondary piston rods have an abutting connection with the valve-actuator sleeve. Thus, upon failure of the primary cylinder to move the valve actuator sleeve to its valve-opening position, fluid pressure may be supplied to the pair of secondary cylinder bores and a substantially greater fluid pressure force may be generated by the cooperating pair of secondary piston rods to effect the shifting of the valve-actuator sleeve to its valve-opening position. Additionally, a collet is provided in each of the bottom ends of the two secondary cylinder bores to effect the locking of the respective secondary piston rods in their valve-opening positions, so that once the secondary cylinder bores are supplied with sufficient fluid pressure to move the safety valve to its fully open position, the safety valve is locked in its fully open position.

Other advantages of the invention will be readily apparent to those skilled in the art from the following detailed description, taken in conjunction with the annexed sheets of drawings, upon which is shown a preferred embodiment of the invention.

BRIEF DESCRIPTION OF DRAWINGS

FIG. 1 is taken at the locations indicated by the planes 1—1 on FIG. 3B.

DESCRIPTION OF PREFERRED EMBODIMENT

Figure 1:
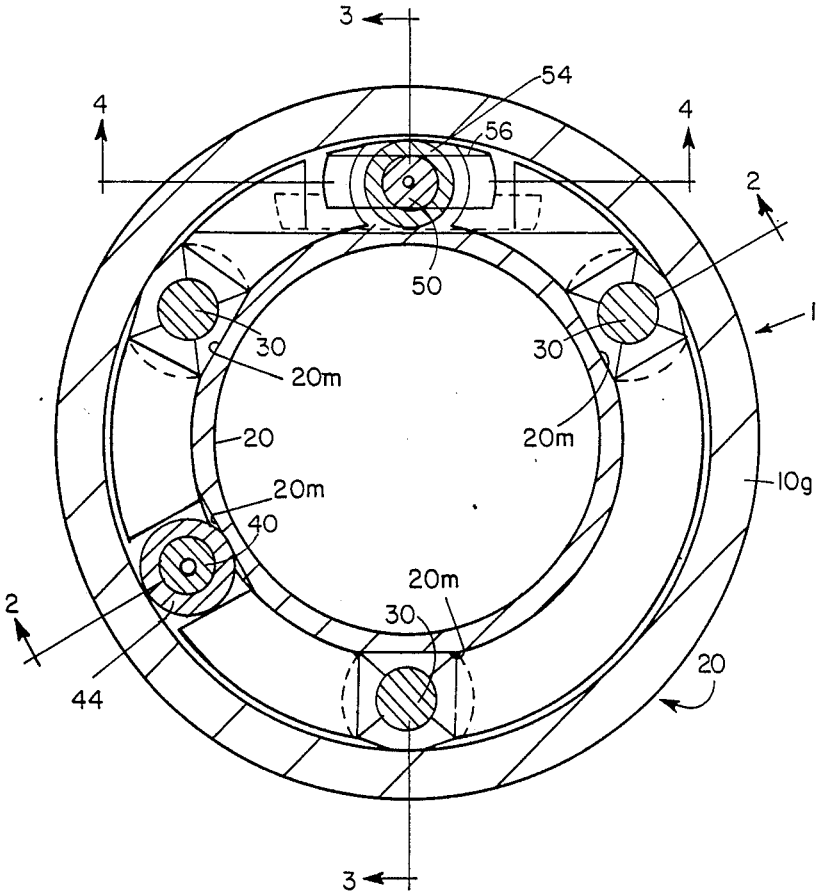
FIG. 1 is a horizontal sectional view of an actuating apparatus for a safety valve embodying this invention.

Referring to FIGS. 1 and 2A through 2D, a safety valve 1 embodying this invention comprises an outer housing assembly 10, a shiftable valve head, in this instance, a flapper valve 15, and an actuating sleeve 20 concentrically mounted for axial movement within the bore of the outer housing assembly and defining an annulus **20*a* surrounding a major portion of the exterior of the actuator sleeve 20 and bounded by an enlarged diameter lower bore portion 10*b* of the outer housing assembly 10**.

Outer housing assembly 10 comprises at its upper end a connecting sub **10*c* having external threads 10*d* cooperating with a main housing body portion 10*e*. Body portion 10*e* is provided at its lower end with external threads 10*f*, which are secured to internal threads provided on the top of a housing sleeve portion 10*g* which defines the internal bore 10*b* which cooperates with the exterior of the actuator sleeve 20 to define the annular space 20*a***.

Sleeve portion **10*g* is provided with internal threads 10*h* which cooperate with corresponding threads provided on the upper end of a valve mounting housing portion 10*j*. The bottom end of the valve mounting housing 10***j* is provided with internal threads 10*k* for mounting the tubular upper end of any appropriate well tool or tubing string 12 which extends downwardly to the production zone of the well. O-rings 11 seal the aforementioned threaded connection.

Figure 2A:
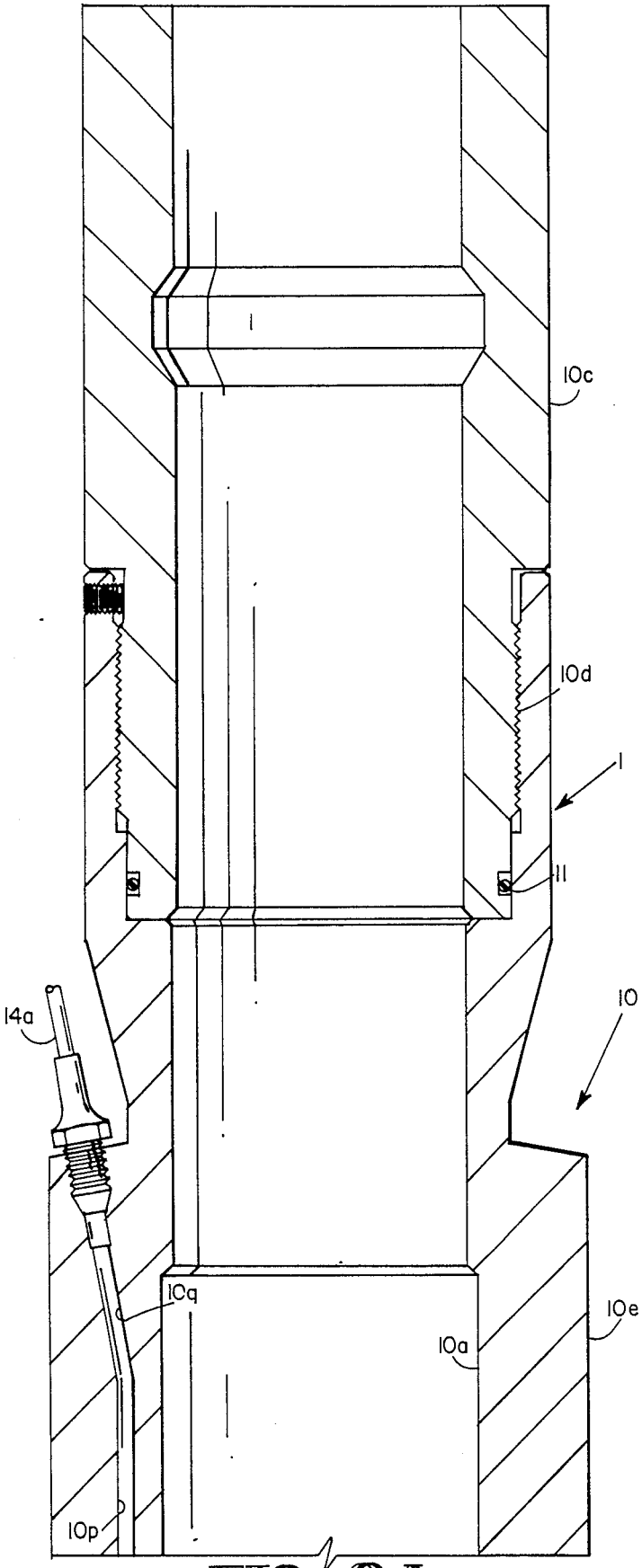
FIGS. 2A, 2B, 2C, and 2D collectively constitute longitudinal sectional views taken on the plane 2—2 of FIG. 1 of a complete safety valve and actuating apparatus therefore embodying this invention.
Figure 2B:
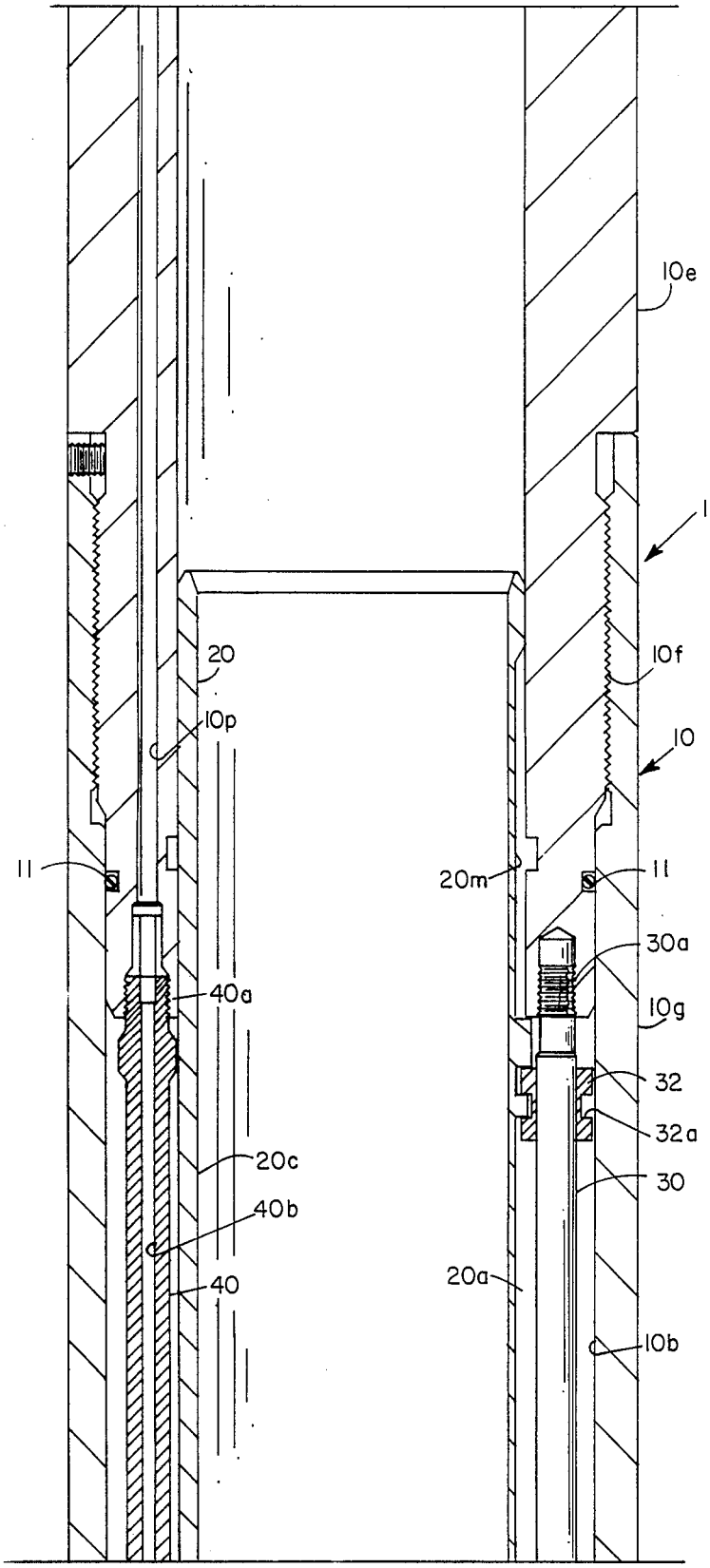
Figure 2C:
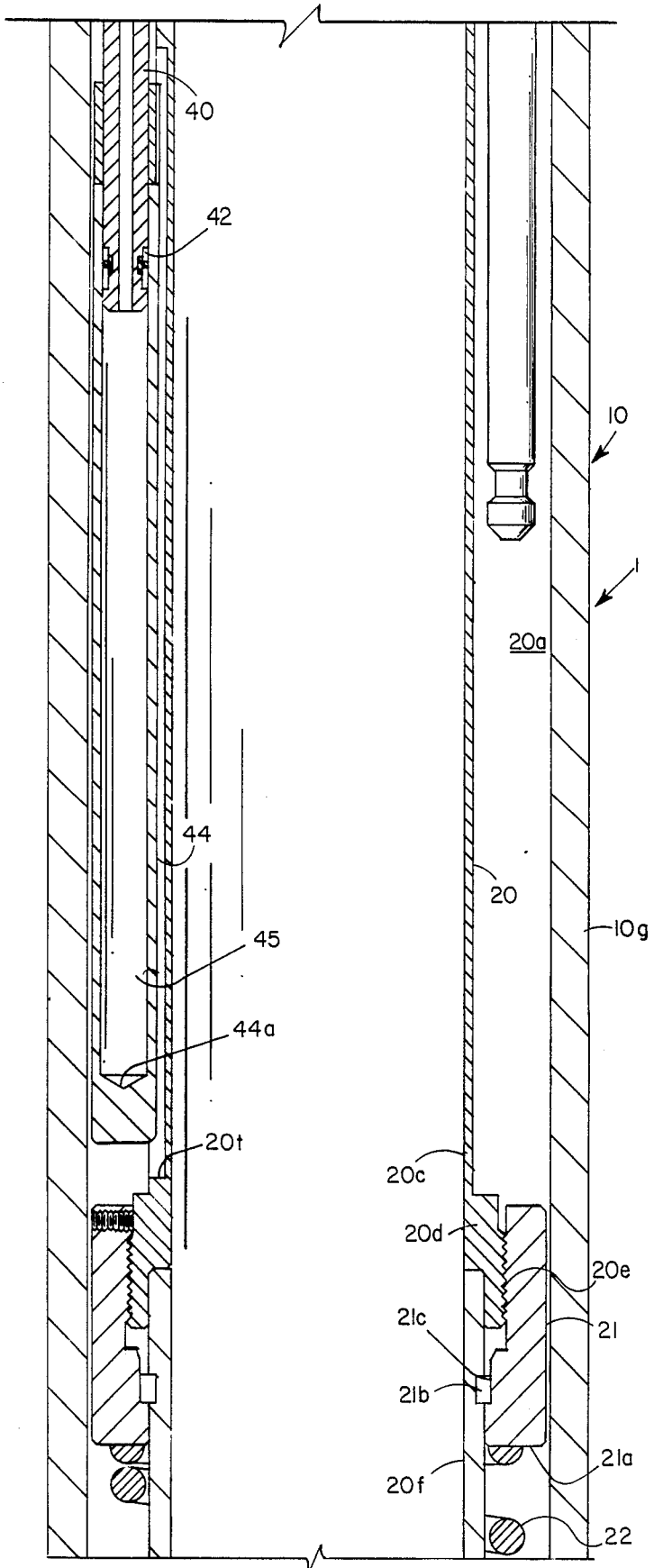
Figure 2D:
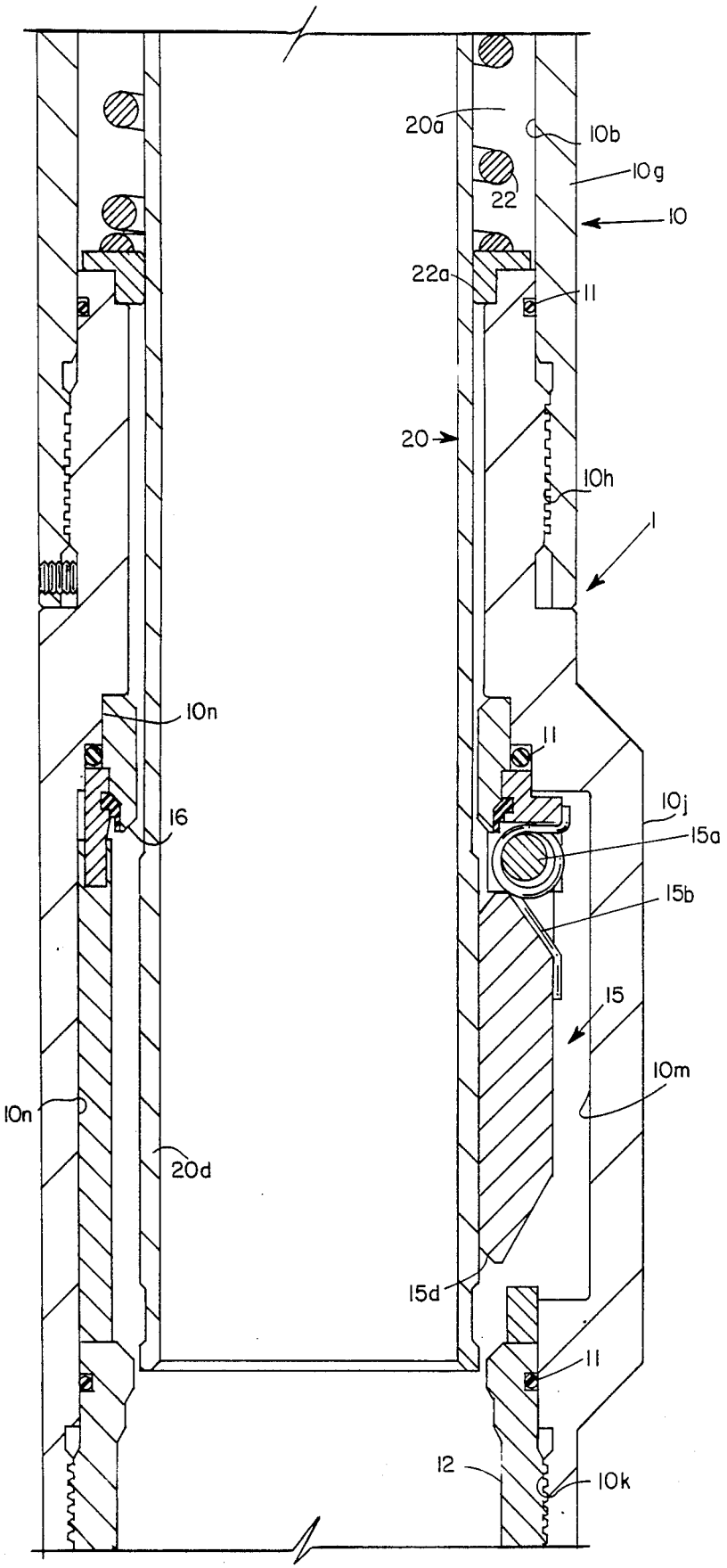

The flapper valve 15 is shown in its open position in FIG. 2D wherein the bottom end 20*d* of the actuator sleeve 20 holds the flapper 15 in an external wall recess 10*m* provided in the valve mounting housing 10*j*. Flapper valve 15 is mounted in the valve mounting housing 10*j* on a transverse pin 15*a* and is biased to a closed position by a torsion spring 15*b*, wherein it traverses the internal bore of the tubular housing assembly. In such closed position, sealing surfaces 15*d* provided on the periphery of the flapper valve 15 sealingly abut metal and elastomeric sealing surfaces provided on a seal assembly 16 which is conventionally mounted within a counter bore 10*n* formed in the valve mounting housing 10*j*. An O-ring 11 effects the sealable mounting of the valve seat assemblage 16 within the counter bore 10*n*.

The valve-actuator sleeve 20 comprises a thin-walled, upper sleeve portion 20*c* terminating at its lower end in a thickened-wall portion 20*d* having external threads 20*e* formed thereon. A lower sleeve portion 20*f* is secured to the upper sleeve portion 20*c* by a connector sleeve 21 which has a downwardly facing surface 21*a* forming a seat for a biasing spring 22. Connector 21 is internally threaded to cooperate with the threads 20*e* and also has a cylindrical surface 21*c* securing a locking ring 21*b* in engagement with an annular groove provided in the top end of a lower actuator sleeve portion 20*f*. Thus, the two sleeve portions 20*c* and 20*f* of the actuator sleeve 20 are regidly secured together and the entire actuator sleeve 20 is biased in an upwardly direction by spring 22 which seats at its lower end on an annular spring seat 22*a* which in turn is mounted on the top end of the valve mounting housing 10*j*.

It will therefore be apparent that manipulation of the actuator sleeve 20 from an upper position, wherein it has no contact with the valve 15, to the lower position shown in FIGS. 2A through 2D secures the valve 15 in an open position. All of the aforesaid construction is conventional and may be found in one or more of the above-cited prior art patents.

Referring specifically to FIGS. 2B and 2C, the fluid pressure operated means for axially shifting the valve sleeve actuator 20 between its aforementioned two positions will now be described. A plurality of spindles 30, 40, and 50 (see FIG. 3B) are mounted in peripherally spaced relationship in the annular space 20*a* defined between the upper end of the actuator sleeve 20 and the internal bore 10*b* of the outer housing assembly 10. Each of the spindles 30, 40, and 50 are of different construction and perform different functions. Those skilled in the art will understand that more than one of each of the spindles 30, 40, or 50 may be provided, if desired. In a preferred embodiment of the invention most clearly illustrated in FIG. 1, three of the solid guide spindles 30 are provided in 120 degree angularly spaced relationship. Intermediate two of the guide spindles 30, a primary hollow spindle 40 is mounted, and intermediate another two of the guide spindles 30 a hollow secondary spindle 50 is mounted. All of such spindles respectively have threaded end portions 30*a*, 40*a*, and 50*a* which are threadably engaged in the bottom end portion of the upper housing portion 10*e*, as best shown in FIGS. 2B, 3B, and 4.

Figure 3A:
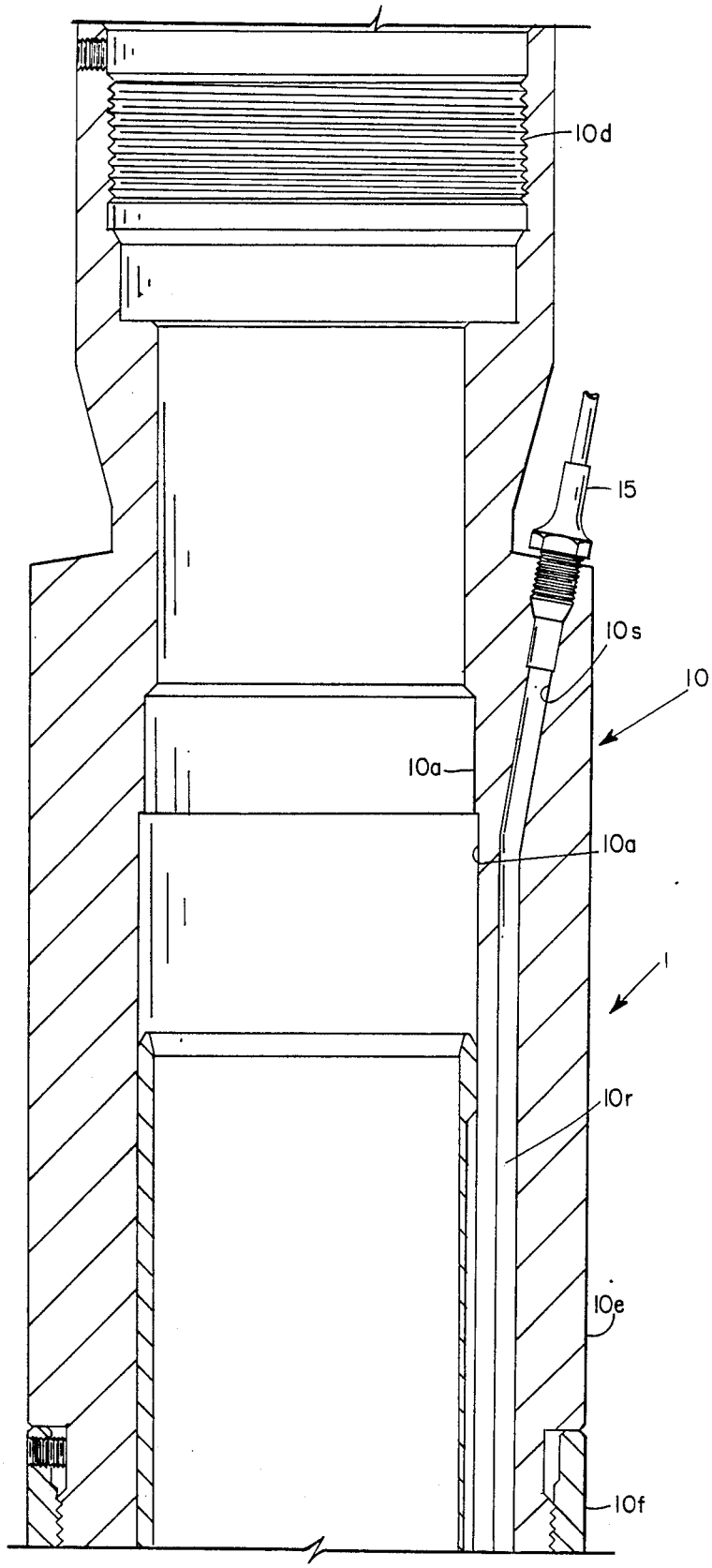
FIGS. 3A and 3B respectively constitute partial longitudinal sectional views taken on the plane 3—3 of FIG. 1.
Figure 3B:
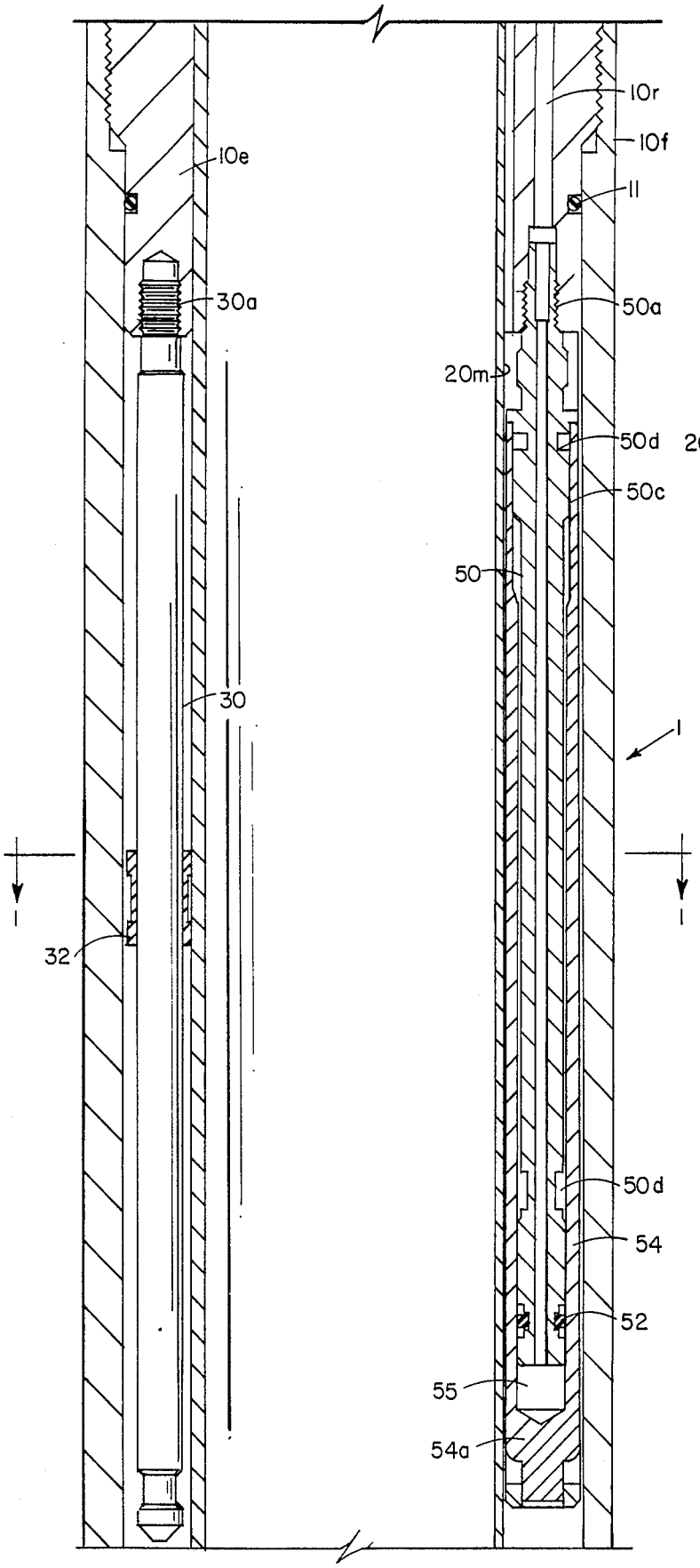
Figure 4:
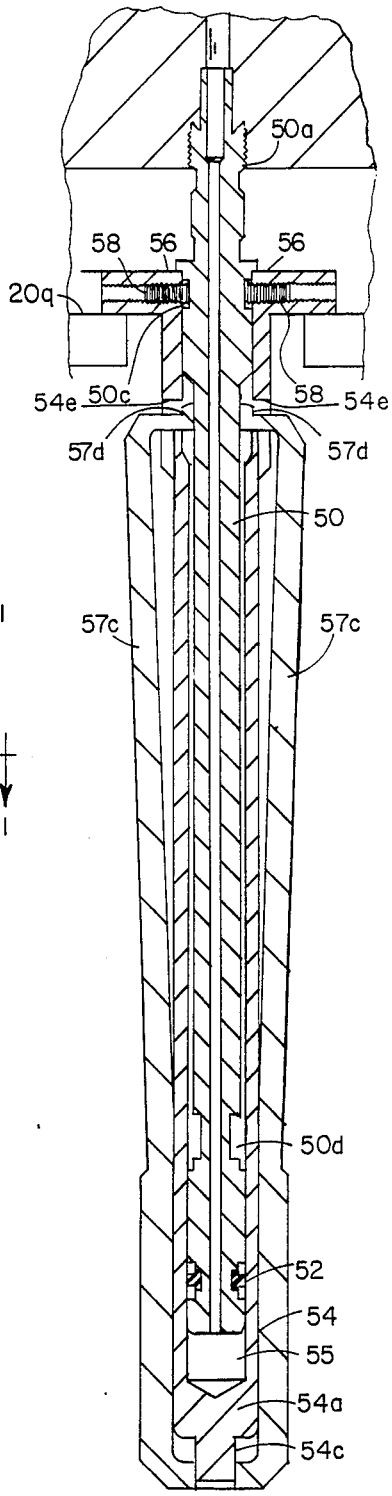
FIG. 4 constitutes a partial longitudinal sectional view taken on the plane 4—4 of FIG. 1, showing the elements of the secondary cylinder and locking collet in their inoperative position.
Figure 6:
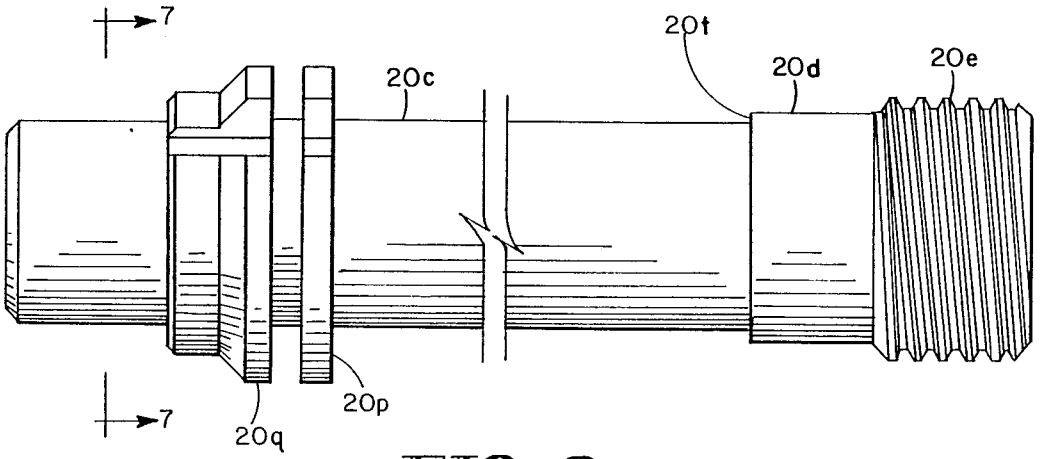
FIG. 6 is an elevational view of the actuator sleeve.

As best shown in FIGS. 2B and 3B, a guide sleeve 32 is provided for each of the guide rods 30. Such sleeves may be conventionally formed from a fiberglass-filled plastic material such as that sold under the DuPont trademark "Teflon". Each guide sleeve 32 is provided with an annular recess 32*a* on its exterior which is engageable with a radial shoulder 20*p* (FIG. 6) formed on the top portions of the actuating sleeve 20. Thus, as actuating sleeve 20 is axially shiftable relative to the outer housing 10, the guide sleeves 32 move with and guide the axial movements of the actuating sleeve 20 by sliding on the three peripherally spaced, fixed guide spindles 30.

Figure 5A:
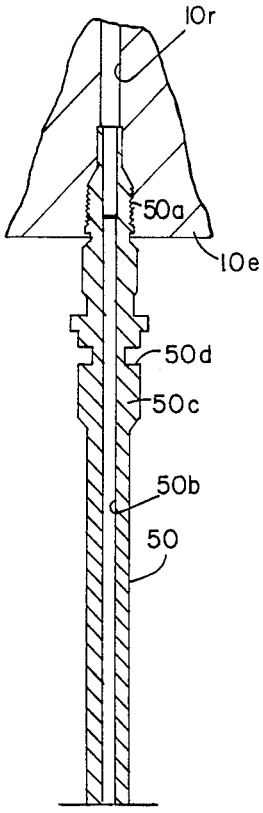
FIGS. 5A and 5B collectively constitute a longitudinal sectional view similar to FIG. 4 but showing the elements of the secondary cylinder and the locking collet in their actuated and locked position.

The hollow spindle 40, which will hereinafter be referred to as the primary spindle, has a hollow bore 40*b* communicating with an axially extending passage 10*p* provided in the upper outer housing portion 10*e* and terminating in an angularly inclined inlet opening 10*q* conventionally communicating with a control fluid pipe 14 extending to the surface of the well. A similar conduit 10*r* (FIGS. 3A and 5A) is provided to communicate with the bore 50*b* of the secondary hollow spindle 50 and extends upwardly to communicate with an inclined conduit 10*s*, which is provided with internal threads for permitting a second control fluid conduit 15 to be connected thereto. On the lower portions of each of the hollow spindles 40 and 50, a piston portion 42 (FIG. 2C) and 52 (FIG. 4) is respectively provided by T-seals conventionally mounted on the exterior of the spindles adjacent their lower ends. A primary cylinder sleeve 44 slidably and sealably cooperates with the primary spindle 40, while a secondary cylinder 54 slidably and sealably cooperates with the secondary spindle 50 (FIGS. 3B and 4). The wall thickness of actuator modate guide sleeves 32 and cylinders 44 and 54.

Each of the primary and secondary cylinders 44 and 54 are provided with closed bottom ends 44*a* and 55*a* respectively. Such closed ends cooperate with the bottom end of the primary spindles 40 and 50 to define fluid pressure chambers 45 and 55, respectively. Thus, fluid pressure supplied from the surface through control line 14 will flow into fluid pressure chamber 45 and exert a downward force on the primary cylinder 44 and, similarly, a fluid pressure supplied from the well surface through control line 15 will flow through the hollow spindle 50 into the fluid pressure chamber 55 and generate a downward force upon the secondary cylinder 54.

The bottom end of primary cylinder 44 is abuttingly engagable with the upper surface 20*t* of the enlarged portion 20*d* of the actuator sleeve top element 20*c* (FIG. 2C). Thus, the application of fluid pressure to the primary cylinder 44 will effect a downward displacement of the actuator sleeve 20 sufficient to effect the opening of the flapper valve 15.

Figure 7:
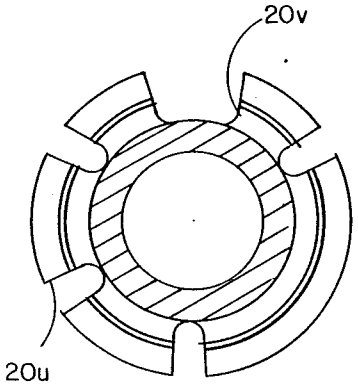
FIG. 7 is a sectional view taken on the plane 7—7 of FIG. 6.

The secondary cylinder 54 is provided at its upper end with two diametrically oppposed radial hubs 56 which are respectively traversed by a threaded bore in which shear screws 58 are threaded. Shear screws 58 respectively engage an annular groove 50*d* provided in the enlarged head portion 50*c* of the secondary spindle 50. The hubs 56 also effect an abutting securement of the secondary cylinder 54 to the actuating sleeve 20. Such hubs respectively overlay second annular rib 20*q* formed on the exterior of the upper portion of the actuating sleeve 20 above rib 20*p* (FIG. 7). Recesses 20*u* and 20*v* on annular ribs 20*p* and 20*q* respectively accommodate cylinders 44 and 54.

It will therefore be apparent that the primary cylinder 44 may be supplied with pressured fluid to shift the actuating sleeve 20 to its valve-opening position without in any manner disturbing the position of the secondary cylinder 54. However, in the event that the primary cylinder 44 does not function, then the application of sufficient fluid pressure to the secondary cylinder 54 will result in shearing screws 58 and a downward movement of the secondary cylinder 54 and the imparting of a downward force to the actuating sleeve 20 by virtue of the abutting contacts of the projections 56 with the annular rib 20*q* on the actuating sleeve 20. Thus, the actuating sleeve 20 may be moved downwardly to effect the opening of the flapper valve 15 through fluid pressure supplied to the secondary cylinder 54.

Figure 5B:
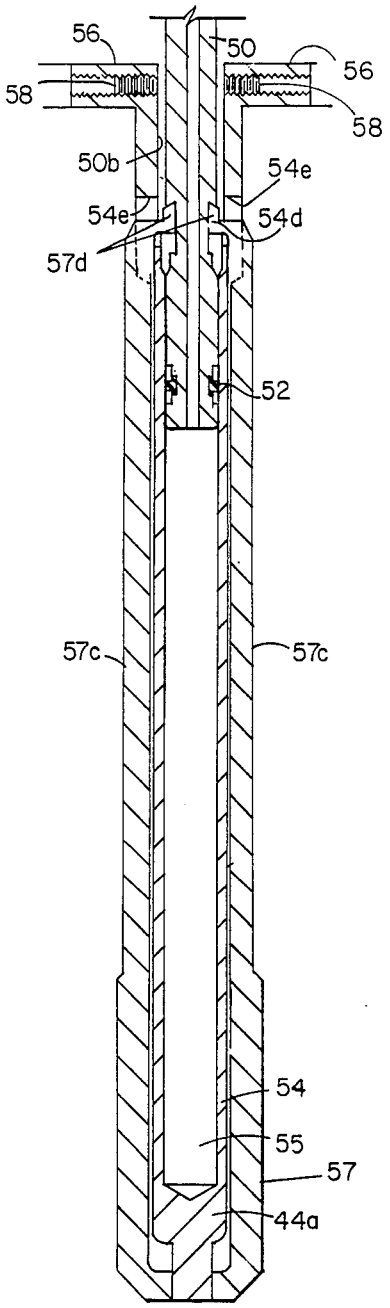

The secondary cylinder 54 also provides a means for locking the actuating sleeve 20 in its valve-opening position. The lower solid end of 54*a* of cylinder 54 is of reduced diameter as indicated at 54*c* and the ring portion 57*a* of a collet 57 is mounted in surrounding relationship to the lower portions of the cylinder 54. Collet 57 is further provided with a pair of diametrically opposed upstanding, resilient arms 57*c* terminating in an enlarged head portions 57*d* which are spring biased inwardly to project through apertures 54*e* provided in the upper portion of the cylinder 54 and engage the exterior surface of the secondary mandrel 50. Secondary mandrel 50 is provided with an annular recess 50*d* adjacent its lower end portion and the collet heads 57*c* will snap into engagement with such annular recess and thus lock the cylinder 54 in its fully extended position. In such locked position, the collet heads 57*d* engage the downwardly facing abutment surface defined by the annular recess 50*d*. See FIG. 5B. Thus, the actuating sleeve 20 is likewise held in its lowermost position, and thus securing the flapper valve 15 in an open position.

Figure 10:
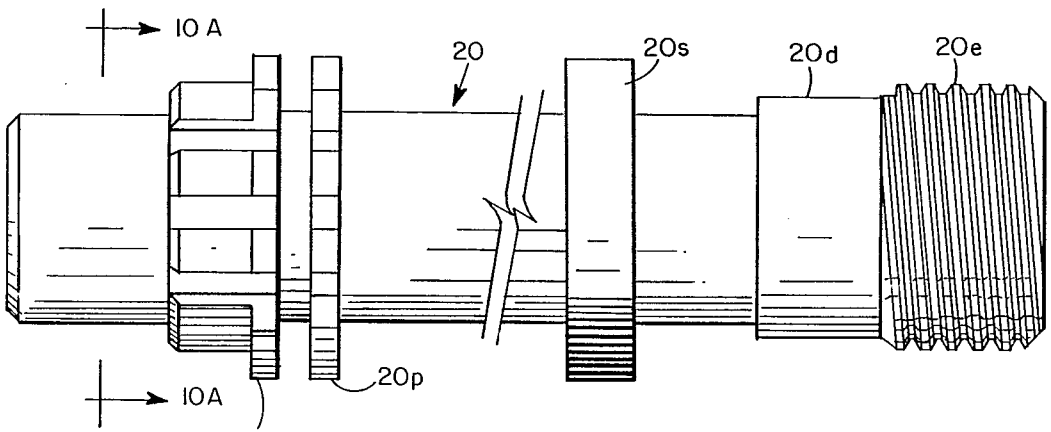
FIG. 10 is a reduced-scale, elevational view of the actuator sleeve employed in the modification of FIGS. 7A and 7B.
Figure 8A:
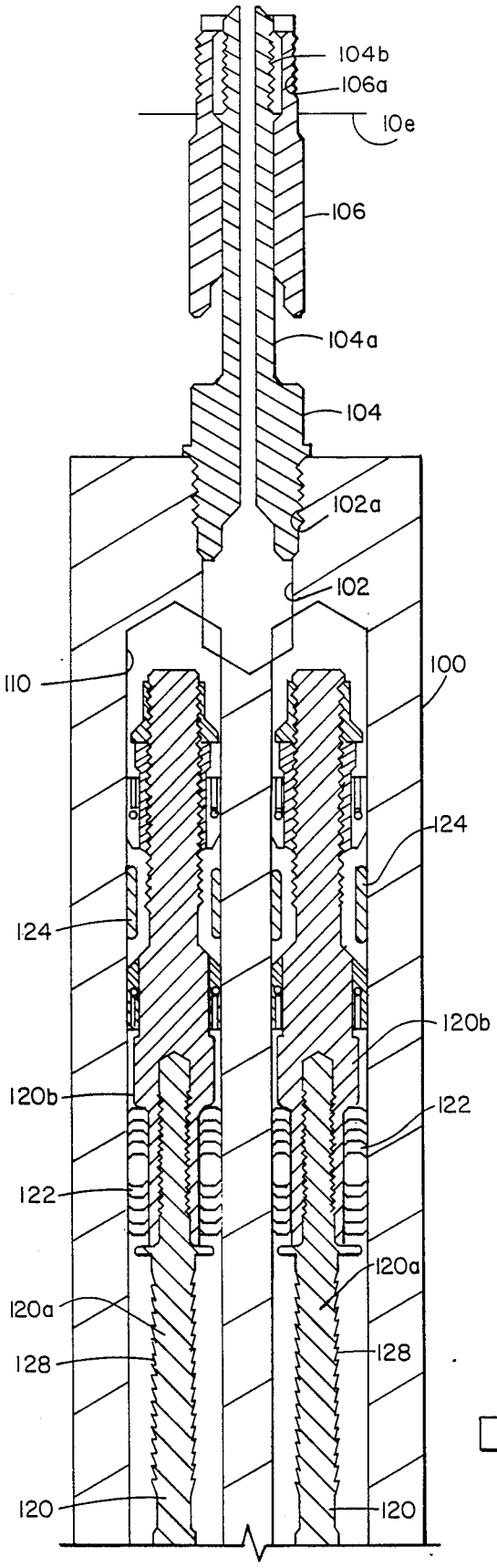
FIGS. 8A and 8B collectively constitute a longitudinal sectional view corresponding to FIGS. 2B and 2C of a modified dual cylinder bore arrangement for effecting the emergency opening and locking of the safety valve in its open position. The elements of the actuating mechanism are shown in their inactive position.
Figure 8B:
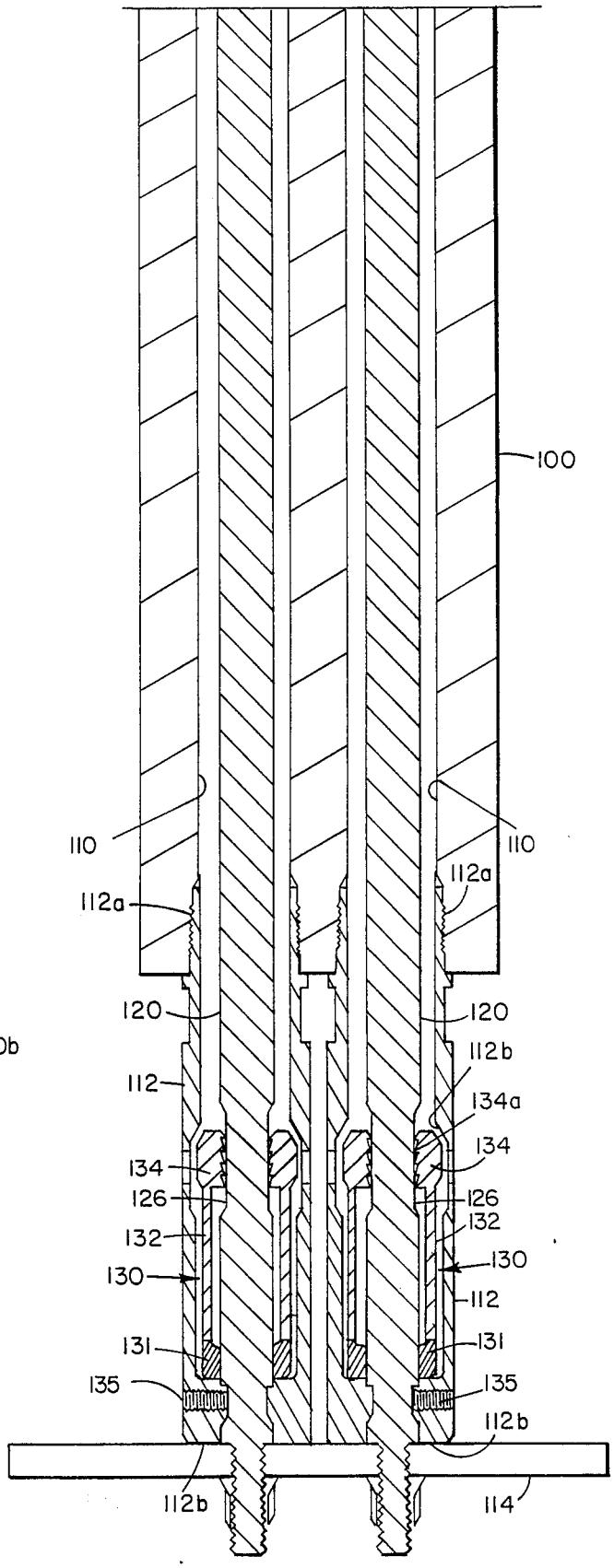
Figure 9A:
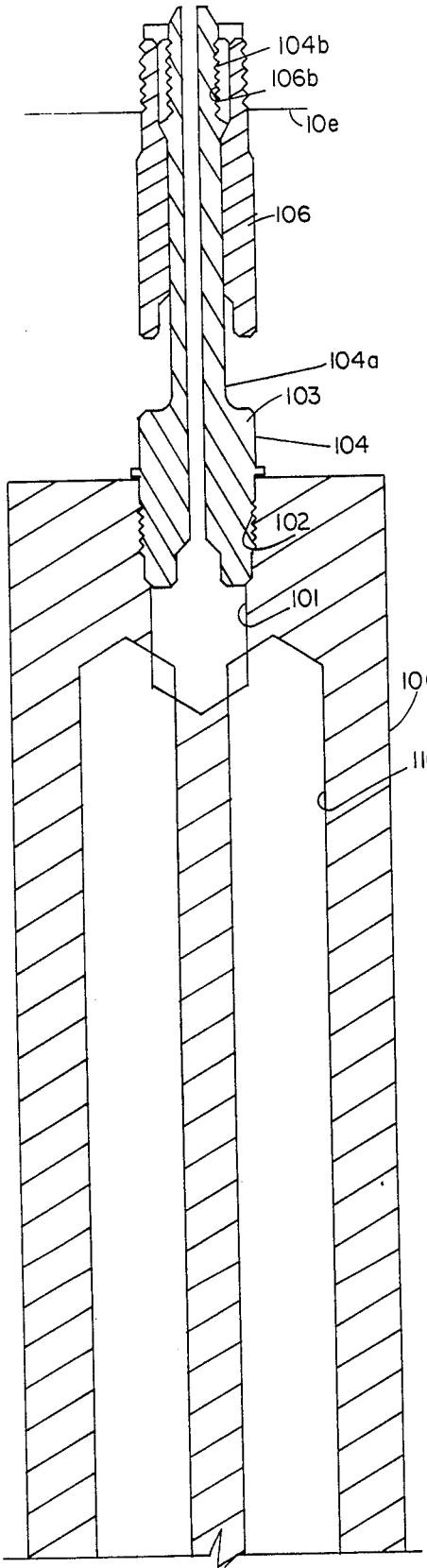
FIGS. 9A and 9B are longitudinal sectional views similar to FIGS. 8A and 8B but showing the elements of the actuating mechanism in their actuated positions wherein the safety valve is locked in a fully open position.
Figure 9B:
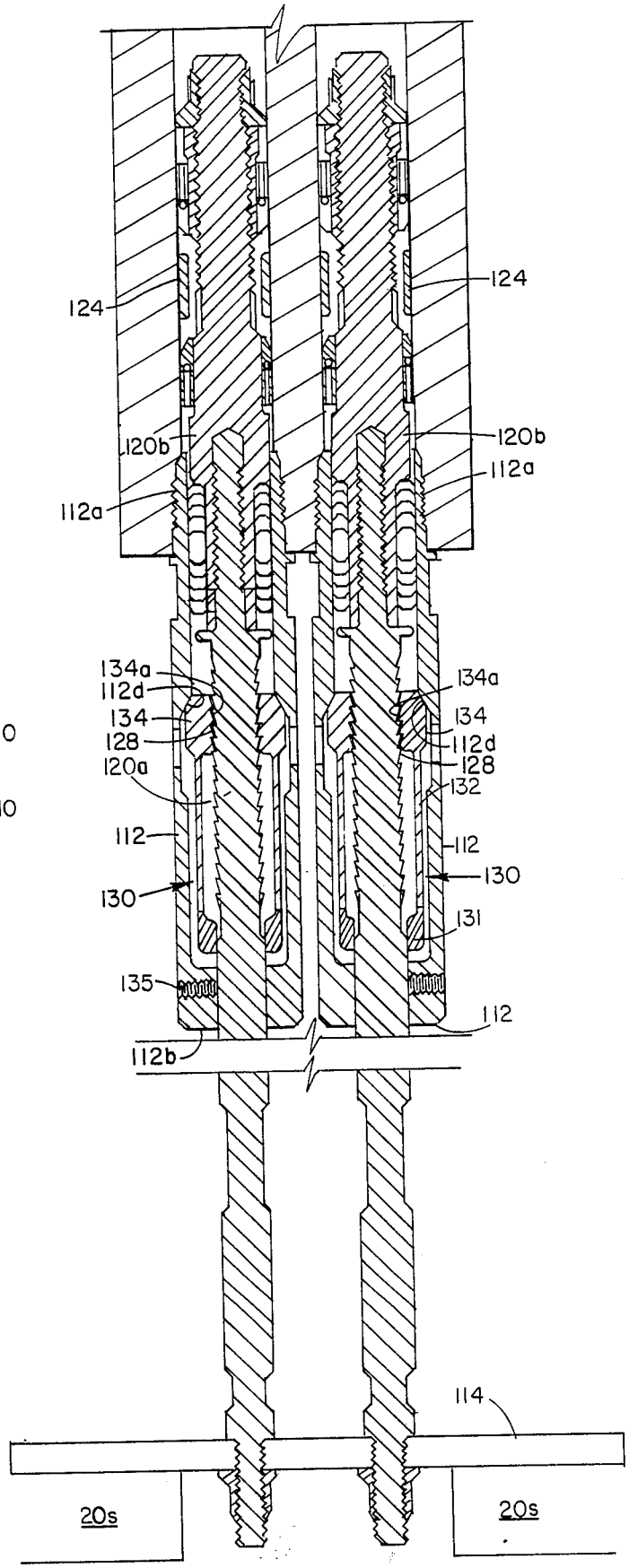

Referring now to FIGS. 8 through 10, there is disclosed an alternative embodiment of this invention wherein two cooperating pistons and cylinders are employed to function as the secondary piston and cylinder means. The utilization of two such piston-cylinder units permits a lower control pressure to be employed and still generate sufficient force to effect the actuation of the actuating sleeve 20 to its valve opening position. Moreover, in this modification, the cylinders are stationary and the piston elements are axially movable.

Figure 10A:
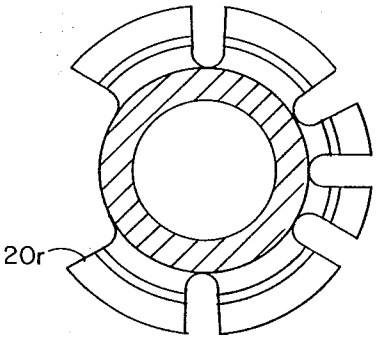
FIG. 10A is a sectional view taken on the plane A—A of FIG. 9.

Thus, a cylinder housing 100 is employed which in external configuration is of generally arcuate contour so as to snugly fit in the space 20*a* provided between the actuating sleeve 20 and the internal bore surface 10*b*. To accommodate the cylinder housing 100 in such annular space, the ribs 20*p* and 20*q* provided on the actuating sleeve 20 are provided with peripherally enlarged recesses 20*r* (FIG. 10A).

The cylinder housing 100 is provided with a central bore 102 (FIG. 8) at its upper end which is in turn internally threaded as indicated at 102*a* to receive therein the lower threaded end of a hollow coupling 104 having a reduced diameter, upwardly extending stem portion 104*a* terminating in an externally threaded portion 104*b*. A housing connecting sleeve 106 is fixedly secured in surrounding relationship to stem portion 104*a* and the housing connecting portion 106 is provided with external threads 106*a* which engage a suitable threaded aperture 106*b* provided in the bottom surface of valve housing portion 10*e* in communication with fluid passage 10*r*. Thus, the cylinder housing 100 is rigidly secured to the valve housing 10.

Cylinder housing 100 is further provided with a pair of axially extending, parallel cylinder bores 110. The upper end of each cylinder bore 110 communicates with the central bore 102 so that fluid communication is provided to the cylinder bores 110 through central bore 102, the bore 104*b* of the connector 104 and the previously described upwardly extending fluid passage 10*r* provided in the housing 10 which communicates with a fluid pressure source at the well through coupling 15 (FIG. 3A).

The bottom ends of cylinder bores 110 are open as shown in FIG. 8B and a collet mounting extension sleeve 112 is mounted by threads 112*a* in each of such open bottom ends of cylinders 110. The bottom ends 112*b* respectively abut an arcuate segment abutment plate 114 which, in the closed position of the valve overlies a rib 20*s* provided on the actuating sleeve 20 (FIG. 10).

Identical pistons 120 are mounted within each of the cylinder bores 110. Each piston 120 is provided at its upper end with a plurality of axially stacked external seal elements 122 which are trapped between the main body portion 120*a* of each piston and a top piston portion 120*b* which is internally threaded to the top portion of the main piston body portion 120*a*. A dynamic seal structure 124 is suitably secured to the top end of each upper piston portion 120*b*.

It is therefore apparent that when fluid pressure is supplied from the surface through the separate control line to the fitting 15, such fluid pressure is operable on the top ends of the pistons 120 and forces such pistons downwardly and out of the cylinder bores 110. The bottom end 120*c* is threadably secured to an arcuate abutment plate 114. The abutment plate 114 is thus urged downwardly and carries with it the actuating sleeve 20 by virtue of the abutting contact with the lower rib 20*s* provided on the actuating sleeve 20 (FIG. 10). Hence, the actuating sleeve 20 can be shifted to its valve opening position.

Within the collet mounting extensions 112 of the cylinder bores 110, the ring portion 131 of a collet 130 is mounted adjacent the lower end of the collet mounting extension 112. Ring portion 131 is slidably mounted relative to the lower portion of the piston rod 120 and, in the closed position of the valve, the collet heads 134 which are mounted on the ends of peripherally spaced, upstanding collet arm portions 132, project inwardly to engage a smooth surface annular recess 126 formed on the lower portions of the piston rods 120.

When fluid pressure is applied to the cylinder bores 110, the piston rods 120 move downwardly bringing an externally threaded portion 128 into the vicinity of the collet heads 134. The internal surfaces of collet heads 134 are provided with threads 134*a* which cooperate with the external threads 128 on the piston rods 120 and effect the locking of such rods in their extreme lower position. Preferably, the threads 128 are formed with a ratchet configuration permitting relative downward movement of the piston rods 120 with respect to the collet heads 134 but preventing upward movement of the piston rods with respect to such collet. Upward movement of the collet heads 134 is prevented by an internally projecting shoulder 112*b* formed on the collet mounting extension 112.

Thus, the operation of this modification is identical to that previously described, namely, when the secondary piston and cylinder arrangement comprising the cylinder bores 110 and the pistons 120, are supplied with fluid pressure from a separate source at the surface, the piston rods 120 are driven downwardly, carrying with them the actuating sleeve 20 and, when the sleeve reaches its lowermost position, corresponding to the open position of the valve 1, the collet 130 is engaged with the threads 128 to prevent return movement of the piston rods 120, thus locking the valve in its open position.

From the foregoing description it will be readily apparent to those skilled in the art that the safety valve embodying the actuating apparatus of this invention permits the operation of the safety valve by a second piston and cylinder arrangement in the event that the primary piston and cylinder mechanism should fail for any reason. More importantly, in the event that recourse has to be had to the secondary piston and cylinder for opening the valve, the valve is concurrently locked in a fully open position so as to ensure that wireline tools and/or treatment fluids may be supplied to the lower portions of the well through the permanently locked open safety valve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a valve for controlling the flow in a fluid transmission conduit in a subteranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in one of said positions holding said valve closure member in said open position and in the other of said two positions permitting said valve closure member to close, and fluid pressure operated means for axially shifting said valve-actuator sleeve to said one position; the improvement comprising: a spindle attached at one end to said housing and disposed in an axially extending position intermediate said valve-actuator sleeve and the axial fluid passage of said tubular housing; means on the other end of said spindle defining a piston; an axially elongated cylinder having a bore slidably and sealably cooperating with said piston and a closed end defining a fluid pressure chamber adjacent said other end of said spindle, said cylinder having a plurality of peripherally spaced ports therein disposed adjacent said one end of said spindle; means for supplying pressured fluid to said fluid pressure chamber, thereby shifting said cylinder axially to abuttingly engage and shift said valve-actuator sleeve to its said one position; and latching means including a collet having a ring portion mounted on the exterior of said cylinder and latching heads projecting through said parts through said cylinder to engage a latching shoulder of said spindle adjacent said position, said latching means being operable between said cylinder and said spindle to secure said valve-actuator sleeve in said one position, thereby locking said valve closure member in its said open position.

2. The apparatus of claim 1 wherein said means for supplying pressured fluid includes an axial bore in said spindle.

3. In a valve for controlling the flow in a fluid in a fluid transmission conduit in a subterranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in a lower one of said positions holding said valve closure member in said open position and in the other of said two positions permitting said valve closure member to close, resilient means urging said valve-actuator sleeve to said other position; said valve-actuator sleeve defining an annular space between its exterior and the axial fluid passage of said housing; a plurality of spindles disposed in said annular space in peripherally spaced, axially extending relation and having upper ends secured to said housing; a first one of said spindles having a hollow bore; means including a first fluid conduit extending to the surface for supplying pressured fluid to the hollow bore of said first spindle; a second one of said spindles being hollow; means including a second fluid passage extending to the surface for supplying pressured fluid to the hollow bore of said second spindle; a first elongated cylinder sealingly engagable with said first spindle, said first cylinder having a closed bottom end defining a first fluid pressure chamber communicating with the bore of said first spindle, whereby fluid pressure supplied to the bore of said first spindle urges said first cylinder to said valve-actuator sleeve, whereby the downward movement of said first cylinder effects the shifting of said valve closure member to its said open position; a second elongated cylinder sealingly engagable with the unsecured end of said second spindle, said second cylinder having a plurality of peripherally spaced ports therein disposed adjacent the unsecured end of said second spindle; said second cylinder having a closed end defining a fluid pressure chamber communicating with the bore of said second spindle, whereby fluid pressure supplied to the bore of said second spindle urges said second cylinder downwardly; means for abuttingly connecting said second cylinder to said valve-actuator sleeve, whereby upon failure of said first cylinder to move said valve-actuator sleeve downwardly, pressured fluid supplied to said second cylinder through said second fluid conduit will shift said valve-actuator sleeve downwardly to open said valve closure member; and latching means including a collet having a ring portion mounted on the exterior of said second cylinder and latching heads projecting through said ports through said second cylinder to engage a latching shoulder of said second spindle adjacent said unsecured and of said second cylinder, said latching means being operable between said second cylinder and said second spindle to secure said valve-actuator sleeve in said valve opening position, thereby locking said valve closure member in its said position.

4. In a valve for controlling the flow in a fluid transmission conduit in a subterranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in a lower one of said positions holding said valve closure member in said open position and in the other of said two positions permitting said valve closure member to close, resilient means urging said valve-actuator sleeve to said other position; said valve actuator sleeve defining an annular space between its exterior and the axial fluid passage of said housing; a plurality of spindles disposed in said annular space in peripherally spaced, axially extending relation and having upper ends secured to said housing; a first one of said spindles having a hollow bore; means including a first fluid conduit extending to the well surface for supplying pressured fluid to the hollow bore of said first spindle; a second one of said spindles having a hollow bore; means including a second fluid passage extending to the surface for supplying pressured fluid to the hollow bore of said second spindle; a first elongated cylinder having a closed bottom end defining a first fluid pressure chamber communicating with the bore of said first spindle, whereby fluid pressure supplied to the bore of said first spindle urges said first cylinder downwardly; means for operatively connecting said first cylinder to said valve-actuator sleeve, whereby the downward movement of said first cylinder effects the shifting of said valve closure member to its said open position; a second elongated cylinder sealingly engagable with said second spindle; said second cylinder having a closed end defining a fluid pressure chamber communicating with the bore of said second spindle, whereby fluid pressure supplied to the bore of said second spindle urges said second cylinder downwardly; means for abuttingly connecting said second cylinder to said valve-actuator sleeve, whereby upon failure of said first cylinder to move said valve-actuator sleeve downwardly, pressured fluid supplied to said second cylinder through said second fluid conduit will shift said valve-actuator sleeve downwardly to open said valve closure member; a bearing sleeve secured to said valve-actuator sleeve and receiving a third one of said spindles in bearing relationship therewith, whereby said third one of said spindles constitutes a guide rod for said valve-actuator sleeve; and including a collet having a ring portion mounted on the exterior of said second cylinder and latching heads projecting through said ports through said second cylinder to engage a latching shoulder of said second spindle adjacent said unsecured and of said second cylinder, said latching means being operable between said second cylinder and said second spindle to secure said valve-actuator sleeve in said valve opening position, thereby locking said valve closure member in its said open position.

5. In a valve for controlling the flow in a fluid transmission conduit in a subterranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in one of said positions holding said valve closure member in said open position and in the other of said two positions permitting said valve closure member to close, and fluid pressure operated means for axially shifting said valve-actuator sleeve to said one position; the improvement comprising: a pair of cylinders disposed in adjacent parallel relationship intermediate the exterior of said valve-actuator sleeve and the axial fluid passage of said tubular valve housing each of the pair of cylinders being axially movable with respect to the valve housing; means for rigidly securing one end of each said cylinder to said valve housing; a piston rod slidably and sealably mounted in each said cylinder; means for concurrently supplying pressure fluid to upper ends of said cylinders, thereby shifting said cylinders axially to abuttingly engage and shift said valve-actuator sleeve to said one position; and latching means mounted in the lower end of each said cylinder and engagable with said respective piston rod to lock same against return movement, thereby locking said valve closure member in its said open position.

6. The apparatus of claim 5 wherein said latching means comprises a pair of collets respectively mounted in the interior of said cylinders in surrounding relation to said piston rods; said piston rods having upper ends with exterior threads thereon; said collet having latching heads spring biased to respectively engage said exterior threads.

7. In a valve for controlling the flow in a fluid transmission conduit in a subterranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in a lower one of said positions holding said valve closure member in said open position and in the other of said two positions permitting said valve closure member to close, resilient means urging said valve-actuator sleeve to said other position; said valve-actuator sleeve defining an annular space between its exterior and the axial fluid passage of said housing; a spindle disposed in said annular space in axially extending relation and having upper end secured to said housing; said spindle having a hollow bore; means including a first fluid conduit extending to the surface for supplying pressured fluid to the hollow bore of said spindle; a primary cylinder having a closed bottom end slidably and sealably mounted on said spindle; said primary cylinder defining a fluid pressure chamber communicating with the bore of said spindle, whereby fluid pressure supplied to the bore of said spindle urges said primary cylinder downwardly; means for operatively connecting said primary cylinder to said valve-actuator sleeve, whereby downward movement of said primary cylinder effects the shifting of said valve closure member to its said open position; secondary piston and cylinder means disposed in said annular space and operatively connected between said housing and said actuator sleeve; means including a second fluid passage extending to the well surface for activating said secondary piston and cylinder means to shift said actuating sleeve to a valve-opening position; and means for latching said secondary piston and cylinder means in their valve opening positions.

8. In a valve for controlling the flow in a fluid transmission conduit in a subterranean well comprising a tubular valve housing defining an axial fluid passage, a valve closure member shiftably mounted in said valve housing for movement between an open and closed position relative to said fluid passage, resilient means biasing said valve closure member to said closed position, a valve-actuator sleeve concentrically mounted within said tubular valve housing for axial movements between two positions relative to said valve closure member, in a lower one of said positions holding said valve closure member in said open position and in the other of said two positions permitting said valve closure member to close, resilient means urging said valve-actuator sleeve to said other position; said valve-actuator sleeve defining an annular space between its exterior and the axial fluid passage of said housing; a plurality of spindles disposed in said annular space in peripherally spaced, axially extending relation and having upper ends secured to said housing; a first one of said spindles having a hollow bore; means including a first fluid conduit extending to the surface for supplying pressurized fluid to the hollow bore of said spindle; a primary cylinder having a closed bottom end slidably and sealably mounted on said first spindle; said primary cylinder defining a first fluid pressure chamber communicating with the bore of said first spindle, whereby fluid pressure supplied to the bore of said first spindle urges said primary cylinder downwardly; means for operatively connecting said primary cylinder to said valve-actuator sleeve whereby downward movement of said primary cylinder effects the shifting of said valve closure member to its said open position; a second one of said spindles having an external cylindrical guide surface; a hollow guide bushing having a bore slidably receiving said second spindle; means for securing said guide bushing to said valve-actuator sleeve, thereby guiding axial movements of said actuator sleeve relative to said tubular valve housing; secondary piston and cylinder means disposed in said annular space and operatively connected between said housing and said actuator sleeve; means including a second fluid passage extending to the well surface for activating said secondary piston and cylinder means to shift said activating sleeve to a valve-opening position; and means for latching said secondary piston and cylinder means in their valve opening position.

9. The apparatus of claims 7 or 8 wherein said latching means comprises a collet carried by said secondary cylinder means.

* * * * *